US008852030B2

(12) United States Patent
Campbell et al.

(10) Patent No.: US 8,852,030 B2
(45) Date of Patent: Oct. 7, 2014

(54) BASKETBALL COLLECTION AND RETURN APPARATUS

(75) Inventors: Douglas Brad Campbell, Loretto, MN (US); Jeffrey Jon Campbell, Lonsdale, MN (US)

(73) Assignee: Airborne Athletics, Inc., Burnsville, MN (US)

( * ) Notice: Subject to any disclaimer, the term of this patent is extended or adjusted under 35 U.S.C. 154(b) by 221 days.

(21) Appl. No.: 13/310,173

(22) Filed: Dec. 2, 2011

(65) Prior Publication Data

US 2012/0142454 A1 Jun. 7, 2012

Related U.S. Application Data

(60) Provisional application No. 61/419,686, filed on Dec. 3, 2010.

(51) Int. Cl.
*A63B 69/00* (2006.01)

(52) U.S. Cl.
CPC ..... *A63B 69/00* (2013.01)
USPC ..... 473/433; 473/447

(58) Field of Classification Search
USPC ..... 473/433, 422, 436, 447, 431, 479, 483, 473/489; 124/6, 16; 56/329
See application file for complete search history.

(56) References Cited

U.S. PATENT DOCUMENTS

| | | | | | |
|---|---|---|---|---|---|
| 229,039 | A | * | 6/1880 | Geyelin | 384/226 |
| 1,211,379 | A | * | 1/1917 | Maisch | 273/368 |
| 1,223,386 | A | | 4/1917 | Handelan | |
| 2,062,807 | A | * | 12/1936 | Cramer | 108/139 |
| 2,667,002 | A | * | 1/1954 | Clore | 40/592 |
| 2,908,266 | A | | 10/1959 | Cooper et al. | |
| 3,776,550 | A | | 12/1973 | McNabb | |
| 3,814,421 | A | * | 6/1974 | Spier, Jr. | 473/433 |
| 3,878,828 | A | | 4/1975 | Francesco | |
| 3,917,263 | A | * | 11/1975 | Wiley | 473/433 |
| 4,168,695 | A | | 9/1979 | Haller et al. | |
| 4,262,648 | A | | 4/1981 | Wegener et al. | |
| 4,471,746 | A | | 9/1984 | Ando | |
| 4,579,340 | A | | 4/1986 | Jenkins et al. | |
| 4,667,957 | A | | 5/1987 | Joseph | |
| 4,678,189 | A | | 7/1987 | Koss | |
| 4,714,248 | A | | 12/1987 | Koss | |
| 4,913,431 | A | | 4/1990 | Jakobs | |
| 4,936,577 | A | | 6/1990 | Kington et al. | |
| 4,940,231 | A | | 7/1990 | Ehler | |
| 4,955,605 | A | | 9/1990 | Goldfarb | |
| 5,016,875 | A | | 5/1991 | Joseph | |
| 5,035,423 | A | * | 7/1991 | Arciniega | 473/433 |

(Continued)

OTHER PUBLICATIONS

Shoot-A-Way, 1-page advertising brochure (pub. date unknown).

(Continued)

*Primary Examiner* — Gene Kim
*Assistant Examiner* — M Chambers
(74) *Attorney, Agent, or Firm* — Kinney & Lange, P.A.

(57) ABSTRACT

A basketball return apparatus for collecting and returning basketballs includes a ball collector, with a top opening and a bottom opening, and a ball returner. The ball returner is connected to a base for receiving balls from the bottom opening of the ball collector and returning the balls to a user. A rotatable support mechanism connects the ball collector to the base so that the ball collector is rotatable with respect to the base and the ball returner.

21 Claims, 13 Drawing Sheets

(56) References Cited

U.S. PATENT DOCUMENTS

| | | | | |
|---|---|---|---|---|
| 5,125,651 | A | 6/1992 | Keeling et al. | |
| 5,183,253 | A | 2/1993 | Grimaldi et al. | |
| 5,312,099 | A | 5/1994 | Oliver, Sr. | |
| 5,393,049 | A | 2/1995 | Nelson | |
| 5,409,211 | A * | 4/1995 | Adamek | 473/433 |
| 5,417,196 | A | 5/1995 | Morrison et al. | |
| 5,540,428 | A * | 7/1996 | Joseph | 473/433 |
| 5,601,284 | A | 2/1997 | Blackwell et al. | |
| 5,634,482 | A * | 6/1997 | Martin | 135/16 |
| 5,676,120 | A | 10/1997 | Joseph | |
| 5,681,230 | A | 10/1997 | Krings | |
| 5,746,668 | A | 5/1998 | Ochs | |
| 5,776,018 | A * | 7/1998 | Simpson et al. | 473/433 |
| 5,813,926 | A | 9/1998 | Vance | |
| 5,842,699 | A | 12/1998 | Mirando et al. | |
| 5,980,399 | A | 11/1999 | Campbell et al. | |
| 6,224,503 | B1 | 5/2001 | Joseph | |
| 6,302,811 | B1 | 10/2001 | Topham | |
| D457,767 | S * | 5/2002 | Schumacher | D6/552 |
| 6,458,049 | B2 | 10/2002 | Bush | |
| 6,659,893 | B1 | 12/2003 | Campbell et al. | |
| 7,288,034 | B2 | 10/2007 | Woodard et al. | |
| 8,147,356 | B2 | 4/2012 | Campbell et al. | |
| 8,206,246 | B2 | 6/2012 | Joseph et al. | |
| 2009/0137347 | A1 | 5/2009 | Jenkins et al. | |
| 2010/0261557 | A1 | 10/2010 | Joseph et al. | |
| 2012/0142454 | A1 * | 6/2012 | Campbell et al. | 473/431 |
| 2013/0005512 | A1 | 1/2013 | Joseph et al. | |
| 2013/0157786 | A1 | 6/2013 | Joseph et al. | |

OTHER PUBLICATIONS

Shoot-A-Way, 12- page advertising brochure (pub. date unknown).

Airborne Atheletics, 1-page advertising brochure (pub. date unknown).

Brochure entitled "Sniper: The Ultimate Basketball Trainer", before Oct. 22, 1995, 5 pages including the cover letter.

* cited by examiner

BASKETBALL COLLECTION AND RETURN APPARATUS

CROSS REFERENCE TO RELATED APPLICATION

This application claims priority to U.S. Provisional Application No. 61/419,686, filed on Dec. 2, 2010, and entitled "Basketball Collection and Return Apparatus," the disclosure of which is incorporated by reference in its entirety.

BACKGROUND

The present invention relates to a basketball return apparatus, and in particular, to a basketball return apparatus with an integrated ball collector.

"Practice makes perfect," so the adage goes. The game of basketball is not exempt from this age old adage. Practice is known to improve a player's basketball skills Taking numerous shots at a basketball hoop is a key element of basketball practice as it develops the player's shooting ability and technique. However, unless a second player is present to rebound for the first player (the shooter), the first player must rebound his or her own shots. This rebounding process wastes time that could otherwise be used by the player to practice skills including shooting.

A wide variety of ball collectors have been conceived to collect basketballs shot at a basketball goal (including a backboard with an attached hoop). These ball collectors generally include netting and a frame positioned under and around the basketball goal. Ball collectors are often used in conjunction with a ball returner, which directs a ball back from the ball collector to the shooter.

When a ball collector is separate and independent from a ball returner, it can be awkward, cumbersome, and time consuming to set up both devices to be used together. When a ball collector and a ball returner are fixedly mounted to a common base, setup can be done more quickly. However, fixing the ball collector with respect to the ball returner in a particular orientation necessarily limits a user's ability to select a different orientation. A single orientation is not necessarily ideal for using the ball collector and ball returner both near and away from the basketball goal.

SUMMARY

According to the present invention, a basketball return apparatus for collecting and returning basketballs includes a ball collector, with a top opening and a bottom opening, and a ball returner. The ball returner is connected to a base for receiving balls from the bottom opening of the ball collector and returning the balls to a user. A rotatable support mechanism connects the ball collector to the base so that the ball collector is rotatable with respect to the base and the ball returner.

Another embodiment of the present invention is a method for operating a basketball return apparatus having a ball collector and a ball returner each connected to a base. The method includes positioning the basketball return apparatus on a basketball court near a basketball goal such that a low portion of a collector rim of the ball collector is proximate the basketball goal and the ball returner is aimed toward a playing area of the basketball court, operating the basketball return apparatus to collect basketballs shot at the basketball goal and return those basketballs to a user when the basketball return apparatus is near the basketball goal, positioning the basketball return apparatus on the basketball court away from the basketball goal such that the ball returner is aimed in a direction toward a playing area of the basketball court, rotating the ball collector with respect to the basketball return apparatus such that the low portion of the collector rim is facing substantially the same direction as the ball returner is aimed, and operating the basketball return apparatus to collect basketballs passed into the ball collector and return those basketballs to the user when the basketball return apparatus is away from the basketball goal.

Another embodiment of the present invention is a basketball return apparatus for collecting basketballs shot at a basketball hoop. The apparatus includes a ball collector, having a top opening and a bottom opening, connected to a base by a support mechanism. The support mechanism is actuable, by a motor, between a first support position where the ball collector is open and a second support position where the ball collector is collapsed.

Another embodiment of the present invention is a method for operating a basketball return apparatus having a ball collector and a ball returner each connected to a base. The method includes positioning the basketball return apparatus on a basketball court near a basketball goal, raising the ball collector from a collapsed position to an extended position via a motor, operating the basketball return apparatus to collect basketballs shot at the basketball goal and return those basketballs to a user, and lowering the ball collector from the extended position to the collapsed position via the motor.

Another embodiment of the present invention is a ball collector having a first inlet, a second inlet, and an outlet.

DETAILED DESCRIPTION

Figure 1:
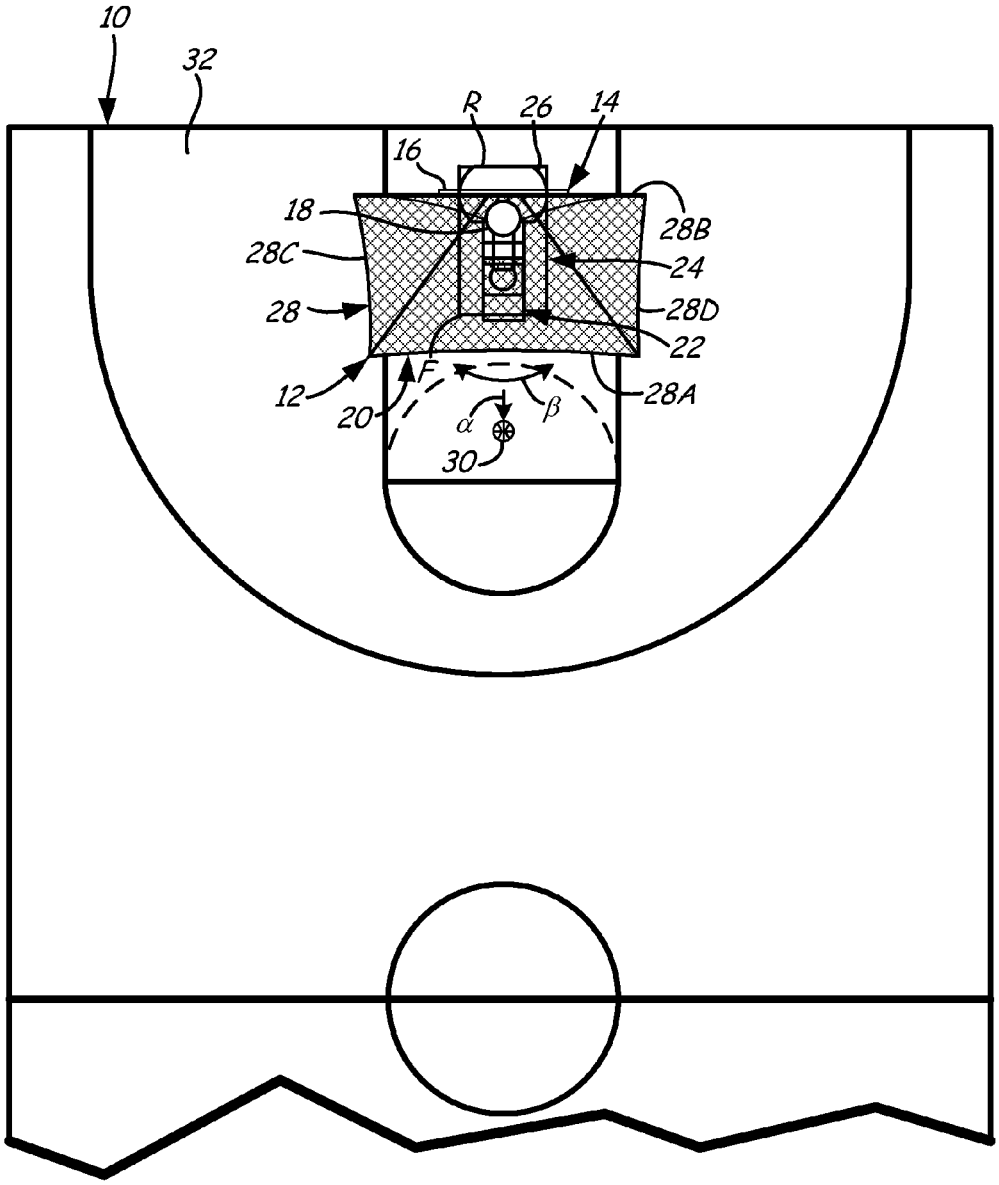
FIG. 1 is an overhead schematic view of a basketball court with a basketball return apparatus positioned for use near a basketball goal.

FIG. 1 is an overhead view of basketball court 10 with basketball return apparatus 12 positioned for use near basketball goal 14, which includes backboard 16 and attached hoop 18. Basketball return apparatus 12 includes ball collector 20 and ball returner 22 each connected to base 24. Ball collector 20 is connected to turntable 26 which is connected to base 24. Turntable 26 allows ball collector 20 to rotate, or swivel, with respect to base 24 and ball returner 22. In FIG. 1, ball collector 20 is in a first rotational position. For reference, we will describe basketball return apparatus 12 as having a front F and a rear R.

Ball collector 20 has a top opening defined by rim 28. In the illustrated embodiment, rim 28 has front portion 28A, back portion 28B, and side portions 28C and 28D. Basketball return apparatus 12 is positioned near basketball goal 14 with ball collector 20 positioned under hoop 18 and back portion 28B of rim 28 substantially adjacent backboard 18. In this position, basketball return apparatus 12 can collect basketballs shot at basketball goal 14 in ball collector 20, which funnels the basketballs to ball returner 22. Rim 28 is substantially larger than hoop 18 so as to collect basketballs that miss or bounce off of basketball goal 14. Front and side portions 28A, 28C, and 28D of rim 28 are vertically higher than hoop 18 to improve the ability of ball collector 20 to collect basketballs that bounce off of hoop 18. Back portion 28B of rim 28 is lower than hoop 18 to allow ball collector 20 to be positioned under hoop 18 without interfering with hoop 18. Typically, hoop 18 is vertically elevated from playing area 32 of basketball court 10 with a height of about 10 feet (about 3.05 meters) above ground level. In one embodiment, front and side portions 28A, 28C, and 28D of rim 28 can have a vertical height of about 11 feet (about 3.35 meters) above ground level and back portion 28B of rim 28 can have a vertical height of about 9.5 feet (about 2.9 meters) above ground level. Thus, front and side portions 28A, 28C, and 28D combine to form a high portion of rim 28, and back portion 28B acts as a low portion of rim 28.

Ball returner 22 can return the collected basketballs to a shooter or another user, by throwing each basketball, such as basketball 30, in a direction $\alpha$. Ball returner 22 can pivot by 210 degrees or more in a direction $\beta$ so as to be able to aim and return basketball 30 to nearly any relevant portion of playing area 32 of basketball court 10. This allows one or more users to practice shooting basketballs at various locations on basketball court 10 without having to rebound the shots. Thus, when positioned near basketball goal 14, basketball return apparatus 12 can collect basketballs shot at basketball goal 14 and throw those basketballs to the users at various locations on playing area 32. Basketball return apparatus 12 can be used, not just on basketball court 10, but on virtually any suitable playing surface, such as a user's driveway.

Figure 2:
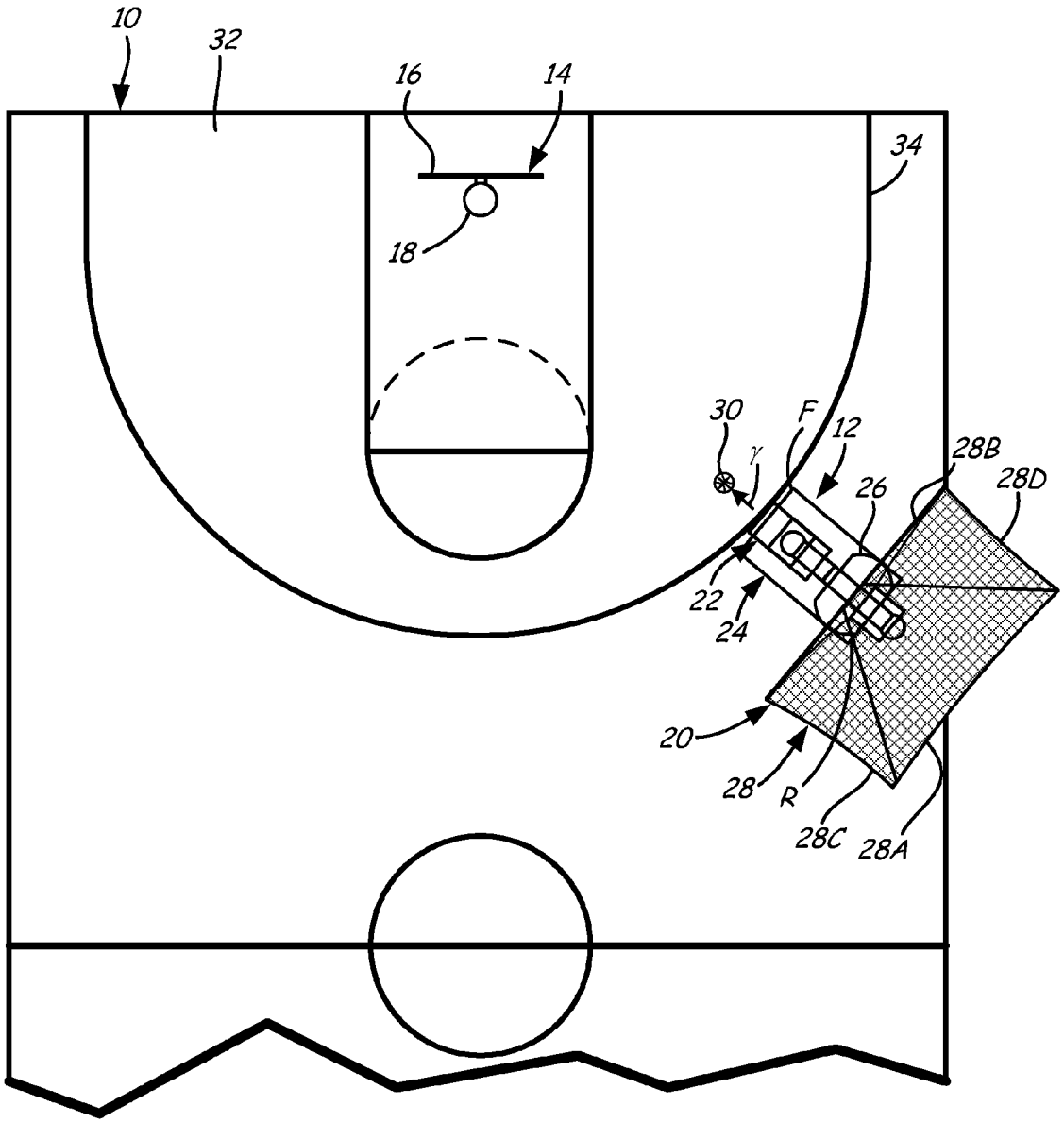
FIG. 2 is an overhead schematic view of the basketball court with the basketball return apparatus of FIG. 1, position for use away from the basketball goal.

FIG. 2 is an overhead view of basketball court 10 with basketball return apparatus 12 position for use away from basketball goal 14. In this case, basketball return apparatus 12 is positioned along three-point arc 34. Ball returner 22 is aimed in a direction $\gamma$ toward playing area 32 of basketball court 10. Turntable 26 has been rotated 180 degrees from the first rotational position (shown in FIG. 1) to a second rotational position, so that ball collector 20 has also been rotated by the same 180 degrees with respect to ball returner 22 and base 24. Rear portion 28B is now facing toward front F of basketball return apparatus 12 in substantially the same direction $\gamma$ as ball returner 22 is aimed.

Thus, when positioned away from basketball goal 14, basketball return apparatus 12 no longer collects basketballs shot at basketball goal 14. Instead, basketball return apparatus 12 can be positioned virtually anywhere on basketball court 10 and used to throw basketball 30 to users at various locations on playing area 32 or even throw basketball 30 toward basketball goal 14. Thus, basketball return apparatus 12 can be used to simulate various passes, such as an inbound pass, a low post pass, a high post pass, lob pass, bounce pass, etc., and also to simulate missed shots for rebounding practice. In order to reload basketball return apparatus 12 with more basketballs, users can pass or throw basketballs over rim 28 into ball collector 20. Rear portion 28B is the low portion of rim 28 of ball collector 20, which is directed substantially toward ball returner 22 and toward playing are 32. This allows users to more easily throw over the relatively low rear portion 28B into ball collector 20, instead of having to throw over the relatively high front portion 28A. Having the relatively high front portion 28A effectively behind rear portion 28B makes it easier for the user to throw basketballs into ball collector 20 without fear of throwing the basketballs over the top of front portion 28A.

Figure 3:
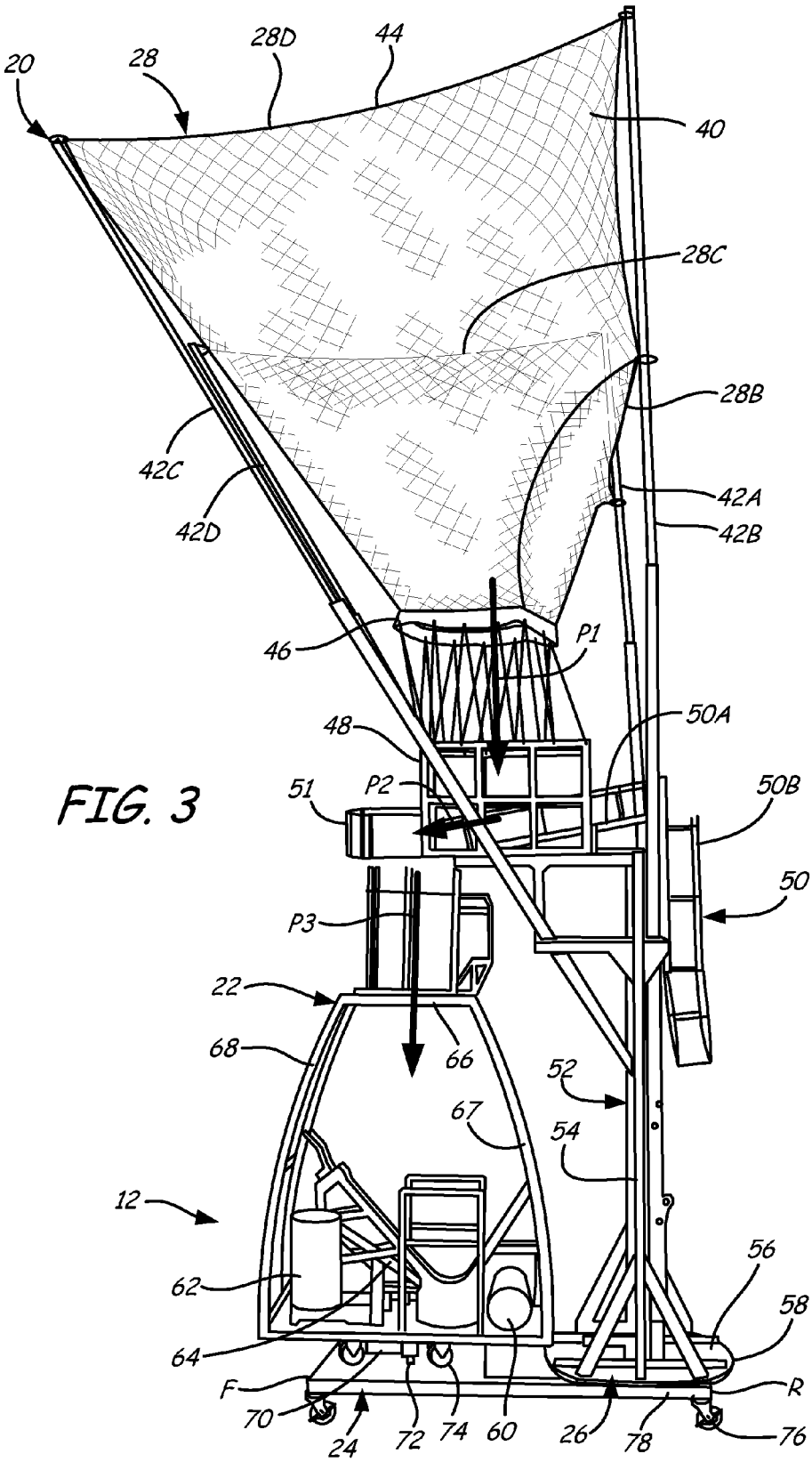
FIG. 3 is a side view of the basketball return apparatus of FIG. 1 with a basketball collector rotated for use near the basketball goal.

FIG. 3 is a side view of basketball return apparatus 12 with basketball collector 20 in the first rotational position, rotated for use near basketball goal 14 (as shown in FIG. 1). In the first rotational position, front portion 28A of rim 28 is rotated toward front F of basketball return apparatus 12, and rear portion 28B is facing toward rear R of basketball return apparatus 12.

In the illustrated embodiment, basketball collector 20 includes net 40 stretched between four telescoping frame poles 42A-42D. Net 40 has top opening 44, defined by rim 28, and bottom opening 46. Bottom opening 46 is tied to ball path cage 48 so as to create first vertical path P1 for basketballs to pass from ball collector 20 to ball path cage 48. Positioned partially inside ball path cage 48 is ramp 50, which includes main ramp section 50A hingedly connected to extendable ramp section 50B. Main ramp section 50A is also hingedly connected to ball path cage 48. When ramp 50 is in a folded ramp position, main ramp section 50A is inclined so that basketballs entering ball path cage 48 along first vertical path P1 are directed forward along first inclined path P2 to end rail 51 of ball path cage 48, at which point the basketballs can drop down along second vertical path P3 into ball returner 22. First vertical path P1, first inclined path P2, and second vertical path P3 collectively form a first ball pathway between ball collector 20 and ball returner 22. When ramp 50 is in the folded ramp position, extendable ramp section 50B is stored vertically against support mechanism 52.

Support mechanism 52 connects ball collector 20, ball path cage 48, and ramp 50 to base 24. Support mechanism 52 includes support frame 54 and turntable 26. Top platform 56 of turntable 26 is rotatably connected to bottom platform 58 of turntable 26, and support frame 54 is fixedly connected to top platform 56. Bottom platform 58 is fixedly connected to base 24.

Turntable 26 can have gasket 59 (shown in phantom in FIG. 7) between top platform 56 and bottom platform 58 to facilitate rotational movement between top platform 56 and bottom platform 58. In one embodiment, gasket 59 can be a circular strip of ultra-high-molecular-weight polyethylene (UHMW) that has a low coefficient of friction and is self-lubricating. In alternative embodiments, gasket 59 can be another type of low friction or lubricated surface. In further alternative embodiments, gasket 59 can be replaced by one or more bearings.

Ball returner 22 receives basketballs from ball path cage 48 through returner inlet 66. In the illustrated embodiment, ball returner 22 is a motorized ball returner having pneumatic pump motor 60, one or more air tanks 62, and throwing arm 64 all connected to ball returner frame 67. Pneumatic pump motor 60 delivers compressed air to air tanks 62. Air in air tanks 62 is released with a valve (not shown) to drive throwing arm 64 to throw basketballs out through returner outlet 68. In other embodiments, ball returner 22 can be another type of motorized ball returner or even a non-motorized ball returner.

Ball returner 22 also has pivot motor 70 fixedly connected to ball returner frame 67. Pivot motor 70 has shaft 72 connected to base 24. Pivot motor 70 drives ball returner 22 to pivot with respect to base 24, as described above with respect to FIG. 1. Pivot motor 70, pneumatic pump motor 60, and the rest of basketball return apparatus 12 can be powered with an on-board direct current (DC) battery (not shown) or by an external 120 volt or 240 volt alternating current (AC) power supply. One or more rollers 74 are attached to ball returner frame 67 for rolling against base 24 and for supporting ball returner 22 as it pivots.

Base 24 has caster wheels 76 attached at each corner of a substantially rectangular base platform 78 for rolling basketball return apparatus 12 to desired positions on and off basketball court 10 (shown in FIGS. 1 and 2). In the illustrated embodiment, base 24 includes a single base platform 78 to which both ball collector 20 and ball returner 22 are attached. In an alternative embodiment, base 24 can have multiple detachable base platforms so that ball collector 20 is detachably connected to ball returner 22.

Figure 4:
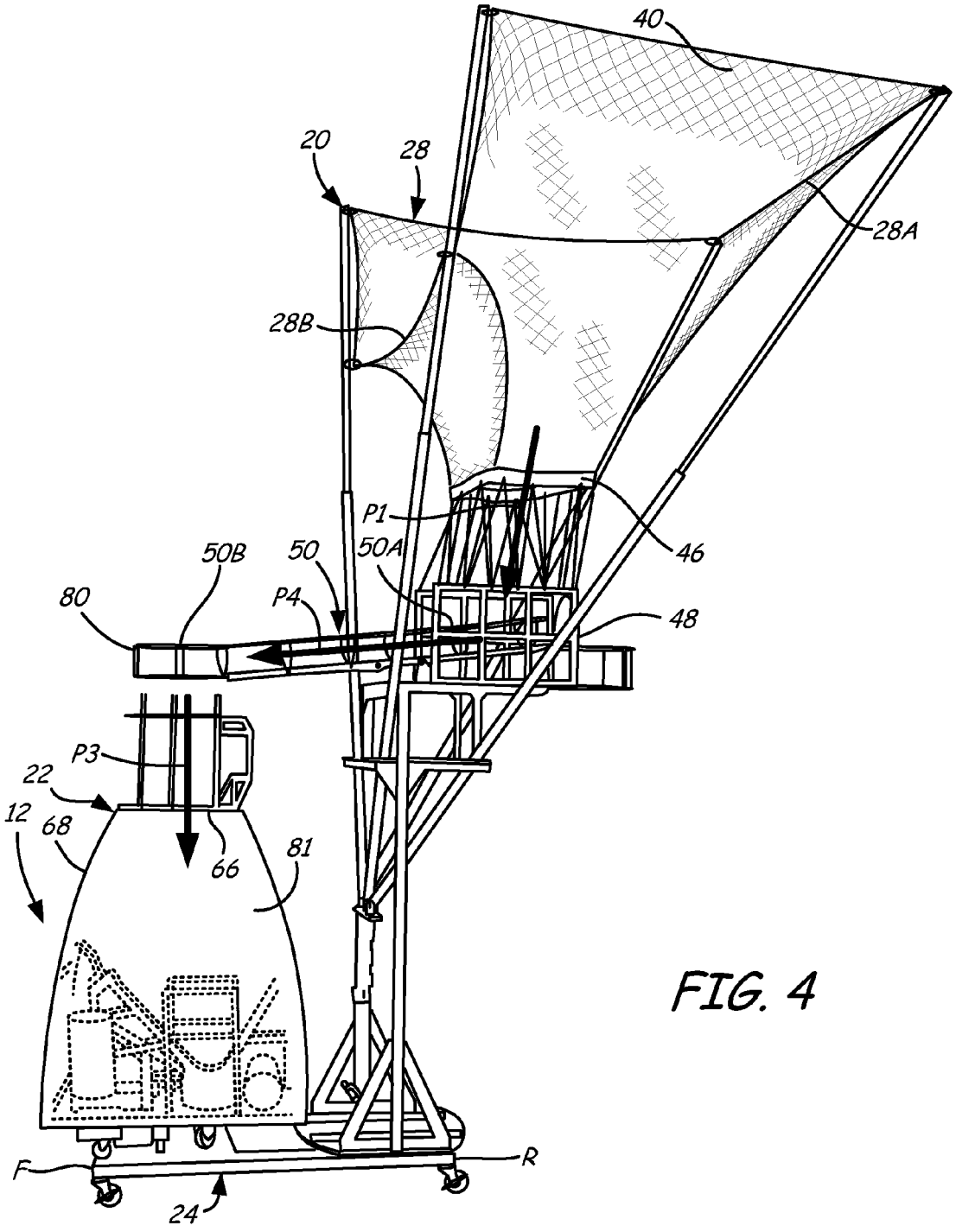
FIG. 4 is a side view of the basketball return apparatus of FIG. 1 with the basketball collector rotated for use away from the basketball goal.

FIG. 4 is a side view of basketball return apparatus 12 with basketball collector 20 in the second rotational position, rotated for use away from basketball goal 14 (as shown in FIG. 2). In the second rotational position, rear portion 28B of rim 28 faces toward front F of basketball return apparatus 12, and front portion 28A is rotated toward rear R of basketball return apparatus 12.

As illustrated in FIG. 4, basketballs pass from bottom opening 46 of ball collector 20 to ball path cage 48 along first vertical path P1, which is substantially the same as in FIG. 3. However, in FIG. 4, ramp 50 is in an extended ramp position, where extendable ramp section 50B is swung up to be substantially in-line with main ramp section 50A. Main ramp section 50A is inclined so that basketballs entering ball path cage 48 are diverted and directed along second inclined path P4 to rail 80, at which point the basketballs can drop down along second vertical path P3 into ball returner 22. First vertical path P1, second inclined path P4, and second vertical path P3 collectively form a second ball pathway between ball collector 20 and ball returner 22. Thus, the second ball pathway (shown in FIG. 4) is substantially the same as the first ball pathway (shown in FIG. 3) except, in the second ball pathway, inclination of ramp 50 redirects basketballs to roll along second inclined path P4, as opposed to rolling along first inclined path P2 (shown in FIG. 3).

Ball returner 22 is shown with its housing 81 in FIG. 4. Housing 81 encloses substantially all of ball returner 22, except for returner inlet 66 and returner outlet 68.

Figure 5:
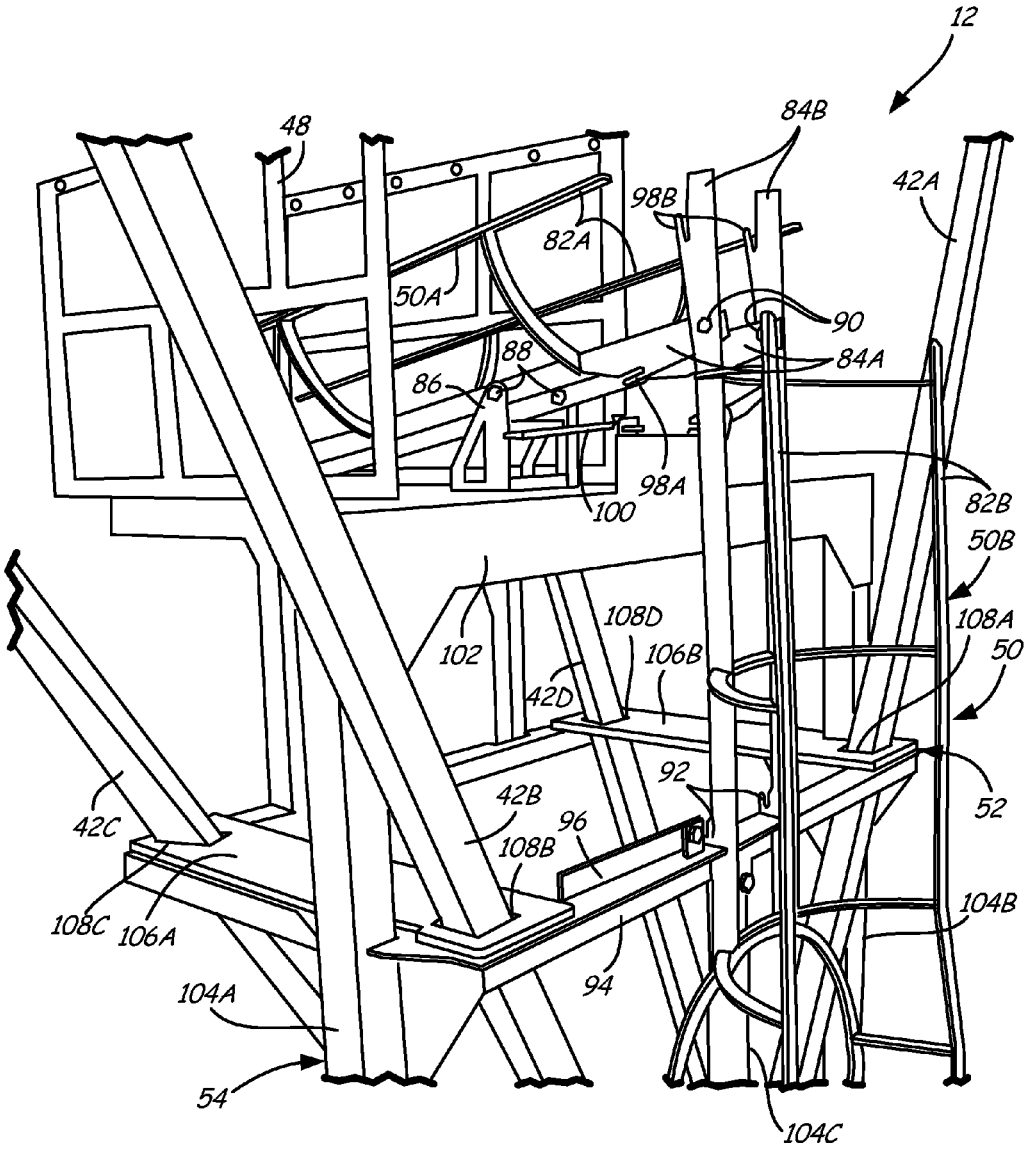
FIG. 5 is an enlarged perspective view of a ramp on the basketball return apparatus of FIG. 1.

FIG. 5 is an enlarged perspective view of ramp 50 of basketball return apparatus 12 in the folded ramp position, shown without net 40 for clarity. Ramp 50 has side rails 82A and 82B and bottom rails 84A and 84B. Bottom rails 84A of main ramp section 50A are hingedly connected to ramp support fulcrum 86 of ball path cage 48 by bolts 88. Bottom rails 84A of main ramp section 50A are also hingedly connected to bottom rails 84B of extendable ramp section 50B by bolts 90.

Bottom rails 84B of extendable ramp section 50B have tabs 92. When ramp 50 is in the folded ramp position, tabs 92 rest against horizontal support bar 94 of support frame 54, thus causing extendable ramp section 50B to hold main ramp section 50A tilted with a desirable inclination. The illustrated inclination is the same as that illustrated for main ramp section 50A in FIG. 3. Latch 96 is hingedly connected to horizontal support bar 94 and can swing to hold tabs 92 in place against horizontal support bar 94. As illustrated, latch 96 is in an open position.

Figure 6:
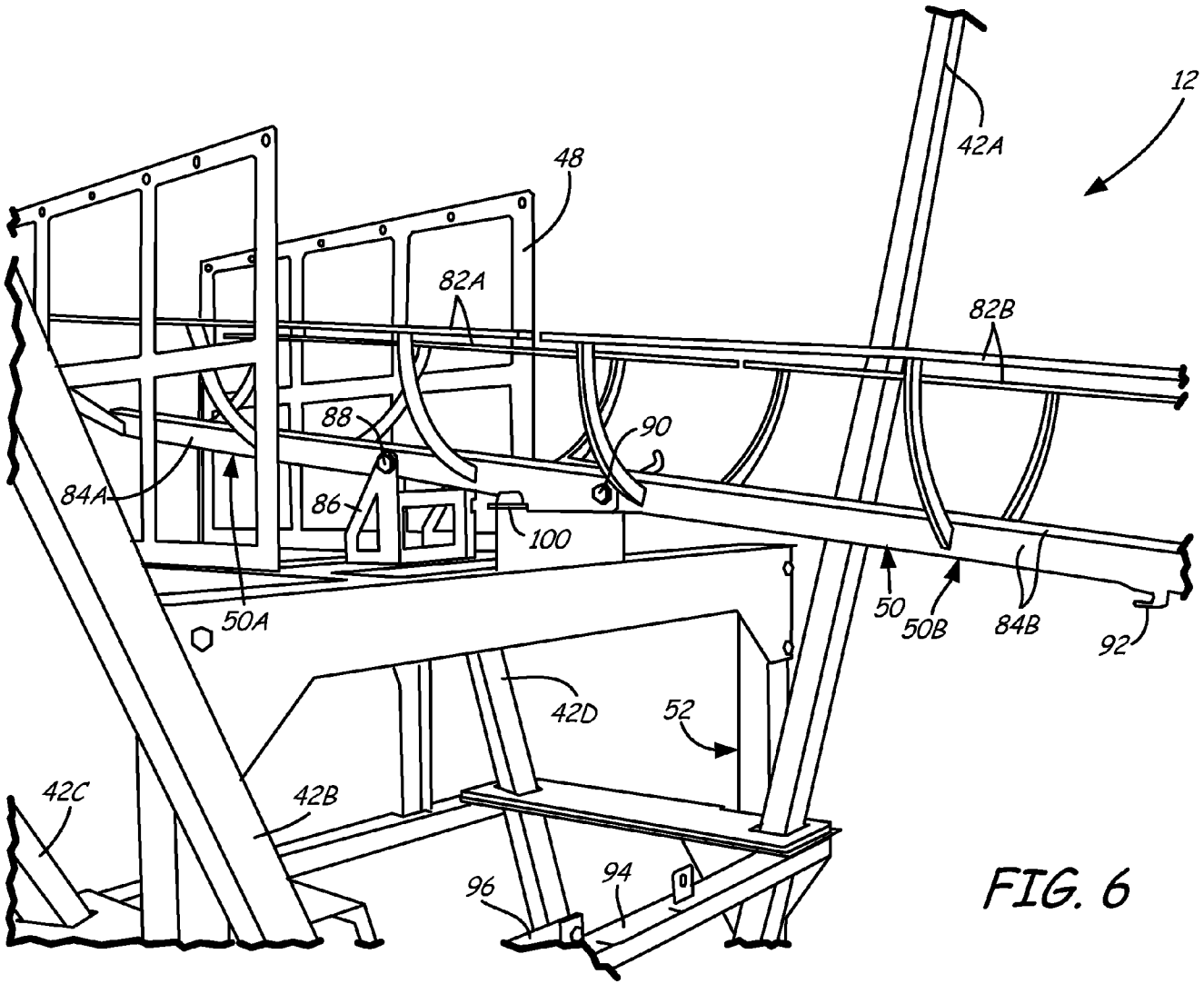
FIG. 6 is an enlarged perspective view of the ramp of FIG. 5 in an extended ramp position.

Bottom rails 84A and 84B also have tabs 98A and 98B, respectively, to allow latch 100 to hold ramp 50 in the extended ramp position (as shown in FIG. 6). Latch 100 is hingedly connected to horizontal support bar 102 of support frame 54 and is illustrated in an open position.

Support frame 54 also includes vertical support poles 104A, 104B, and 104C. Horizontal support bar 94 connects vertical support poles 104A, 104B, and 104C together. Horizontal support bar 102 connects vertical support poles 104A and 104B together. Guide plates 106A and 106B are each connected to horizontal support bar 94, and have guide holes 108A-108D. Frame poles 42A-42D are slidably positioned in guide holes 108A-108D, respectively. Guide holes 108A-108D function in a manner further explained with respect to FIGS. 7-11.

FIG. 6 is an enlarged perspective view of ramp 50 in the extended ramp position. When ramp 50 is in the extended ramp position, latch 100 holds tabs 98A and 98B (shown in FIG. 5) in place, which holds both main ramp section 50A and extendable ramp section 50B tilted with a desirable inclination. The illustrated inclination is the same as that illustrated for ramp 50 in FIG. 4.

Figure 7:
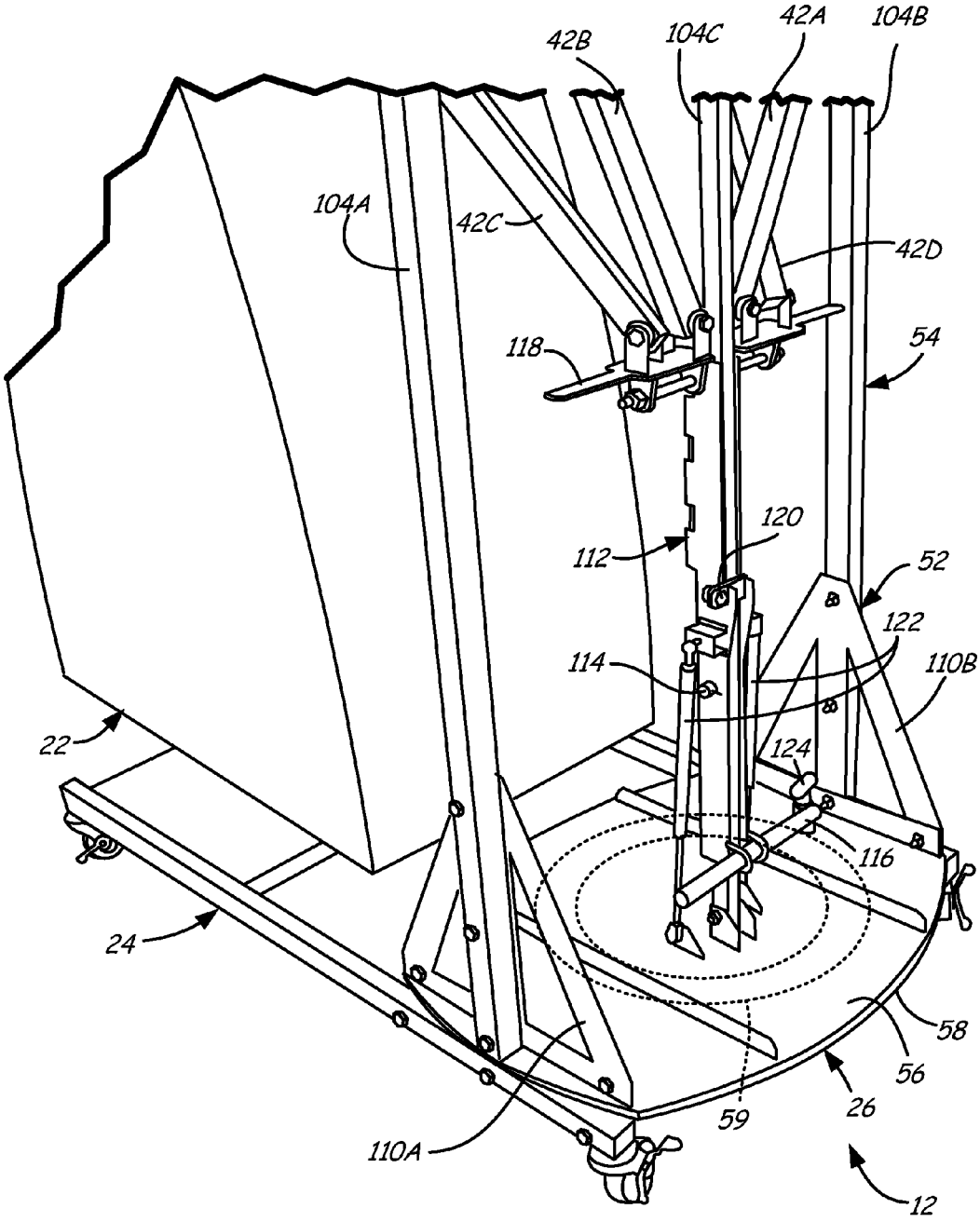
FIG. 7 is an enlarged perspective view of a support mechanism on the basketball return apparatus of FIG. 1 in a first support position.

FIG. 7 is an enlarged perspective view of support mechanism 52 in a first support position. Support mechanism 52 is also in the first support position as shown in FIGS. 1-6. Vertical support poles 104A, 104B, and 104C extend from top platform 56 of turntable 26. Vertical poles 104A and 104B are fixedly connected to top platform 56 by trusses 110A and 110B, respectively.

Support mechanism 52 further includes lever bar 112 hingedly connected to vertical support pole 104C at pin 114. In the first support position, lever bar 112 is aligned substantially vertically against vertical support pole 104C. Lever bar 112 includes handle 116 and ball collector connection plate 118 at opposite ends. In the first support position, ball collector connection plate 118 is positioned vertically higher than handle 116. Frame poles 42A-42D of ball collector 20 (shown in FIGS. 1-4) are hingedly connected to ball collector connection plate 118 so that lever bar 112 can support ball collector 20 in an extended, open position. Ball collector 20 is illustrated in the extended, open position in FIGS. 1-4.

Latch 120 is hingedly connected to vertical support pole 104C for holding lever bar 112 in the first support position. Gas springs 122 are hingedly connected to lever bar 112 between pin 114 and ball collector connection plate 118 and also hingedly connected to top platform 56 of turntable 26. Gas springs 122 act like a spring to bias lever bar 112 toward the first support position. In the illustrated embodiment, gas springs 122 are standard gas springs supplied by H.A. Guden Co., Inc. of Ronkonkoma, N.Y. In alternative embodiments, gas springs 122 can be replaced by another type of spring, such as a wire coil spring (not shown).

Also shown in FIG. 7 is gasket 59, described above with respect to FIG. 2. Lock pin 124 extends through holes in both top platform 56 and bottom platform 58 to lock turntable 26 in position. Lock pin 124 can be pulled to allow turntable 26 to be rotated and then pressed back down to lock when turntable 26 is rotated 180 degrees, or rotated to another desired position.

Figure 8:
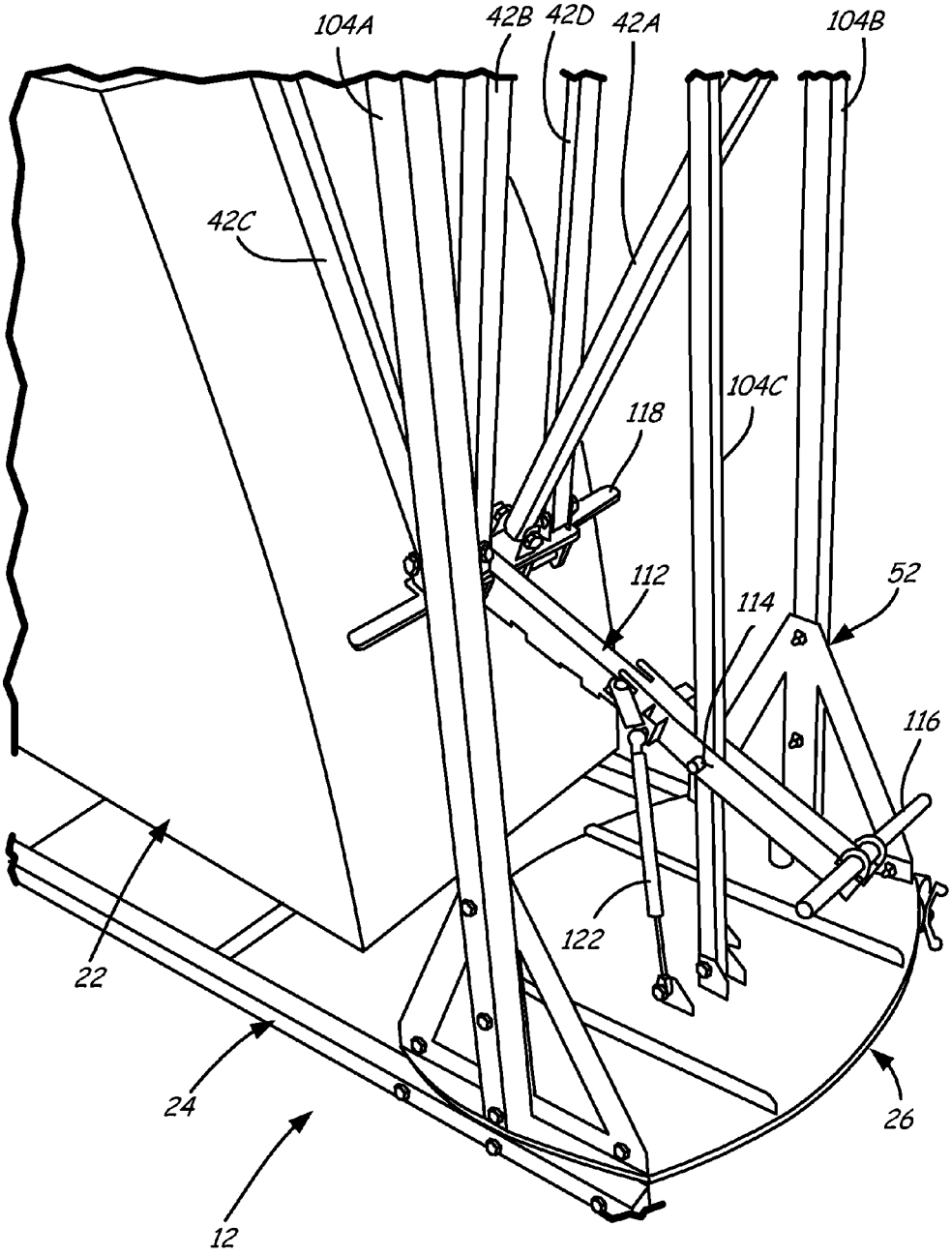
FIG. 8 is an enlarged perspective view of the support mechanism of FIG. 7 in a transition support position.

FIG. 8 is an enlarged perspective view of support mechanism 52 in a transition support position between the first support position (shown in FIG. 7) and the second support position (shown in FIG. 8). In the transition support position, lever bar 112 is rotated about pin 114. Handle 116 can be used to manually rotate lever bar 112. When transitioning between the first support position and the second support position, frame poles 42A-42D slide along guide holes 108A-108D (shown in FIG. 5).

Figure 9:
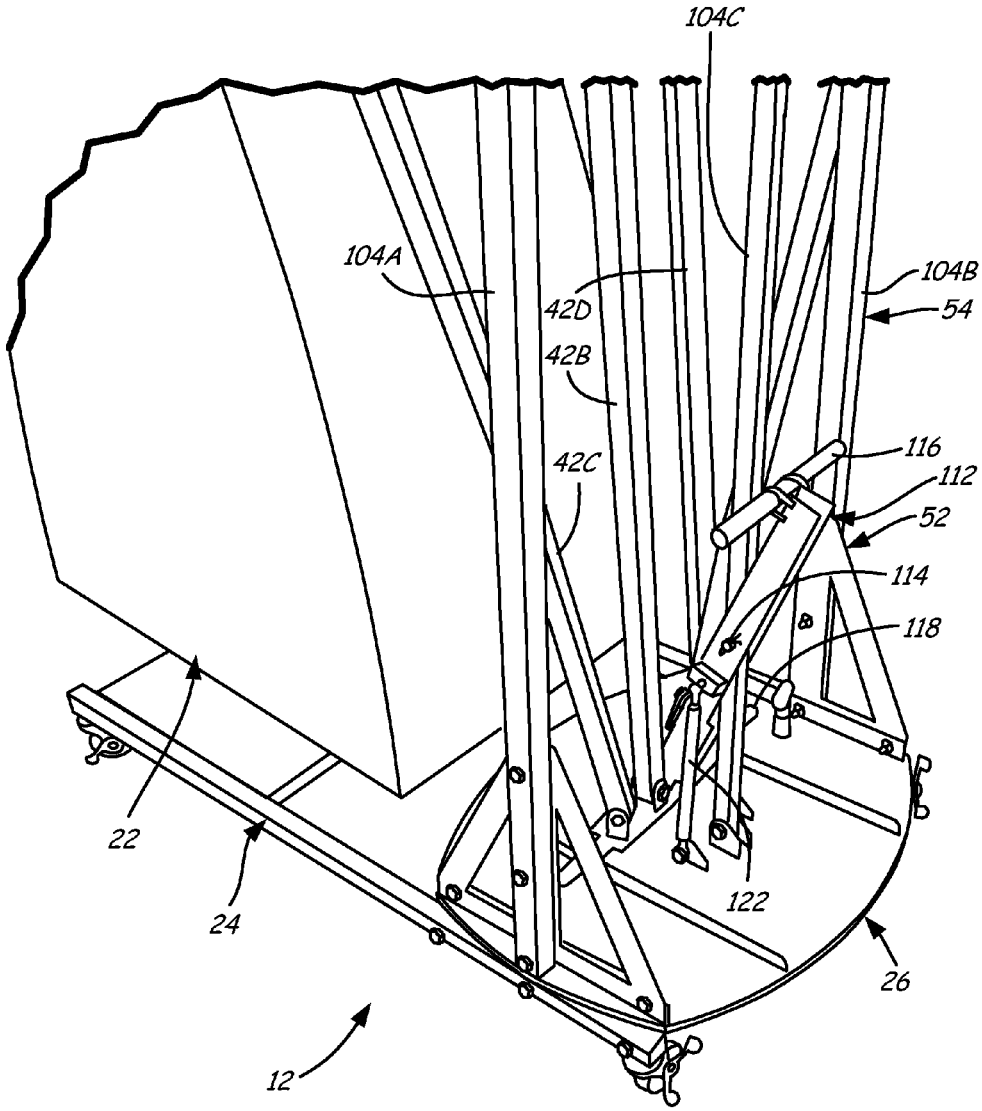
FIG. 9 is an enlarged perspective view of the support mechanism of FIG. 7 in a second support position.

FIG. 9 is an enlarged perspective view of support mechanism 52 in the second support position. In the second support position, ball collector connection plate 118 is positioned vertically lower than handle 116 and rests against turntable 26. When support mechanism 52 is actuated from the first support position (shown in FIGS. 1-4 and 7) to the second support position (shown in FIGS. 9 and 10), frame poles 42A-42D slide down along guide holes 108A-108D (shown in FIG. 5), thus reducing basketball return apparatus 12 to a more compact size. Conversely, when support mechanism 52 is actuated from the second support position to the first support position, frame poles 42A-42D are lifted along guide holes 108A-108D to an elevated position, thus raising and opening ball collector 20.

Figure 10:
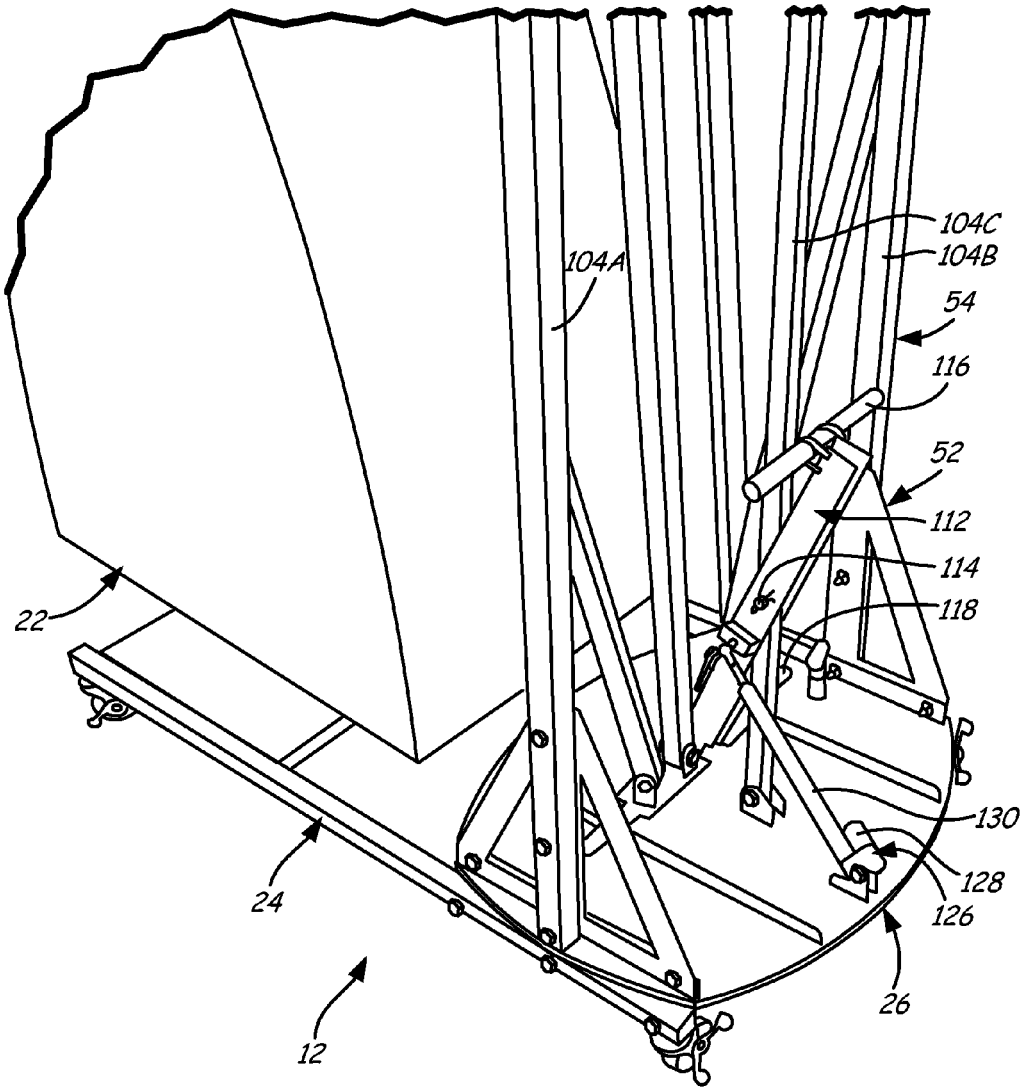
FIG. 10 is an enlarged perspective view of the support mechanism of FIG. 7 combined with a powered motor.

FIG. 10 is an enlarged perspective view of support mechanism 52 having powered actuator 126. FIG. 10 is substantially the same as FIG. 9 except that gas springs 122 (shown in FIGS. 7-9) have been replaced with powered actuator 126. In the illustrated embodiment, powered actuator 126 is screw-driven linear actuator model number FA-PO-150-12-06 manufactured by Firgelli Automations of British Colombia, Canada. Powered actuator 126 is connected between turntable 26 and lever bar 112. Powered actuator 126 includes electric motor 128 and screw cylinder 130. Support mechanism 52 can be actuated manually using handle 116 or automatically using powered actuator 126. Powered actuator 126 is electrically driven to actuate support mechanism 52 between the first and second support positions.

Figure 11:
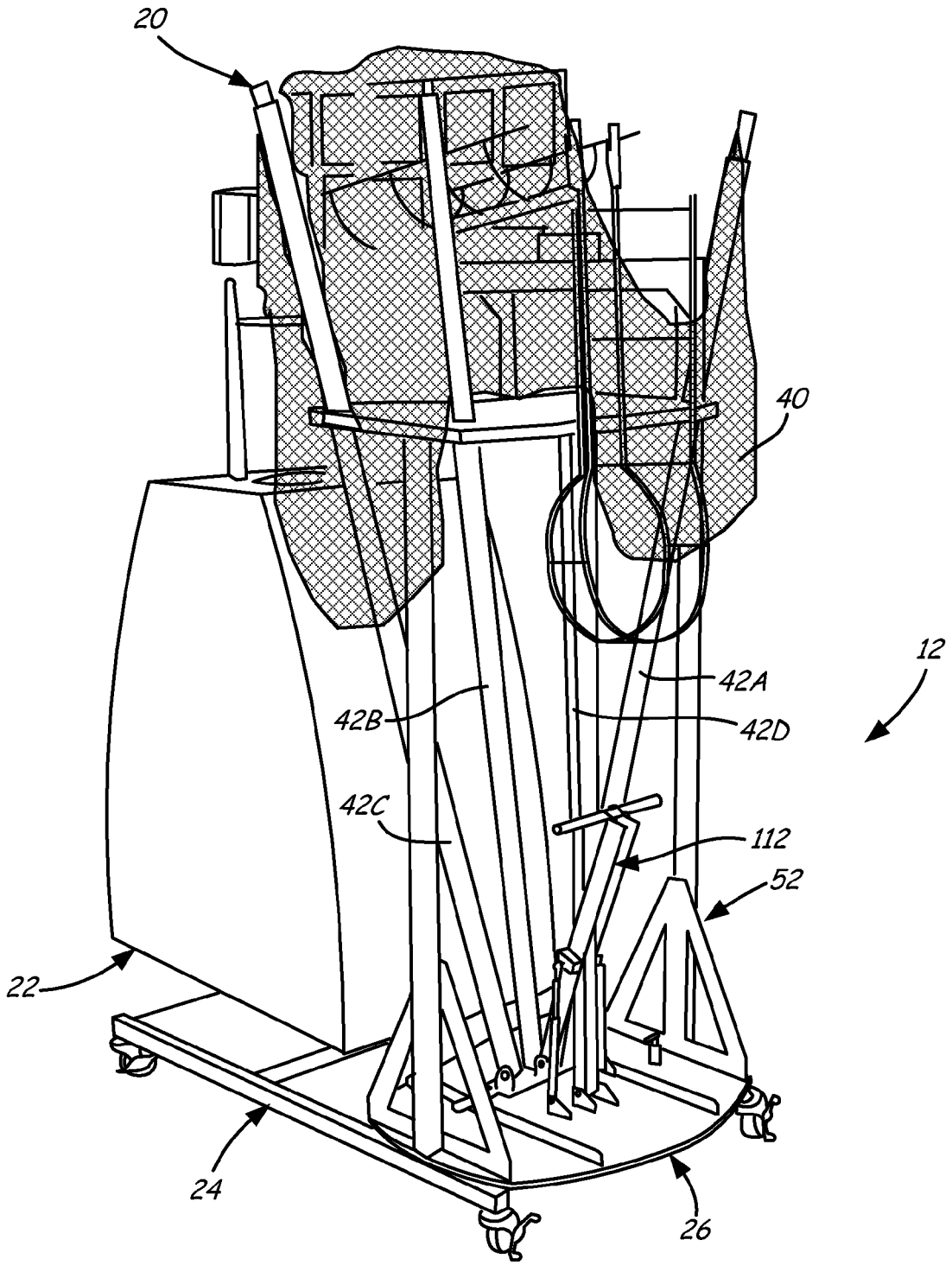
FIG. 11 is a perspective view of the basketball return apparatus of FIG. 1, with the support mechanism in the second support position.

FIG. 11 is a perspective view of basketball return apparatus 12, with support mechanism 52 in the second support position. In the second support position, the size of basketball return apparatus 12 is reduced both vertically and horizontally by support mechanism 52 lowering frame poles 42A-42D, and thus lowering and collapsing ball collector 20. Each of frame poles 42A-42D are also retracted, telescopically, to further reduce the size of basketball return apparatus 12 for transportation and/or storage. As such, basketball return apparatus 12 has a suitably compact size so as to fit through a standard personal doorway. Such doorways typically measure about 30 to 36 inches (about 72 to 91 centimeters) by about 80 inches (about 203 centimeters). When ball collector 20 is collapsed, net 40 drapes down over basketball return apparatus 12.

Thus, basketball return apparatus 12 offers numerous benefits and advantages. Basketball return apparatus 12 combines ball collector 20 and ball returner 22 on a single base 24, allowing for relatively quick and convenient set-up and storage. Support mechanism 52 offers a sturdy and convenient way to lift and lower ball collector 20. Support mechanism 52 can be equipped with a spring, powered actuator 126, and/or gas springs 122 to assist with lifting and lowering of ball collector 20. Support mechanism 52 is further equipped with turntable 26 to allow ball collector 20 to rotate with respect to ball returner 22 and base 24. Allowing ball collector 20 to be rotatable improves the usefulness of basketball return apparatus 12 both near and away from basketball goal 14. When basketball return apparatus is away from basketball goal 14 and ball collector 20 is rotated 180 degrees with respect to ball returner 22, ball collector 20 is oriented to be substantially more effective at catching basketballs thrown to it from the front of basketball return apparatus 12. Because ramp 50 is extendable and functions as described, basketballs can pass from ball collector 20 to ball returner 22 along either the first ball pathway or the second ball pathway, each ball pathway being useful depending on how ball collector 20 is rotated. Therefore, basketball return apparatus 12 can be substantially more useful and convenient than other devices.

Figure 12:
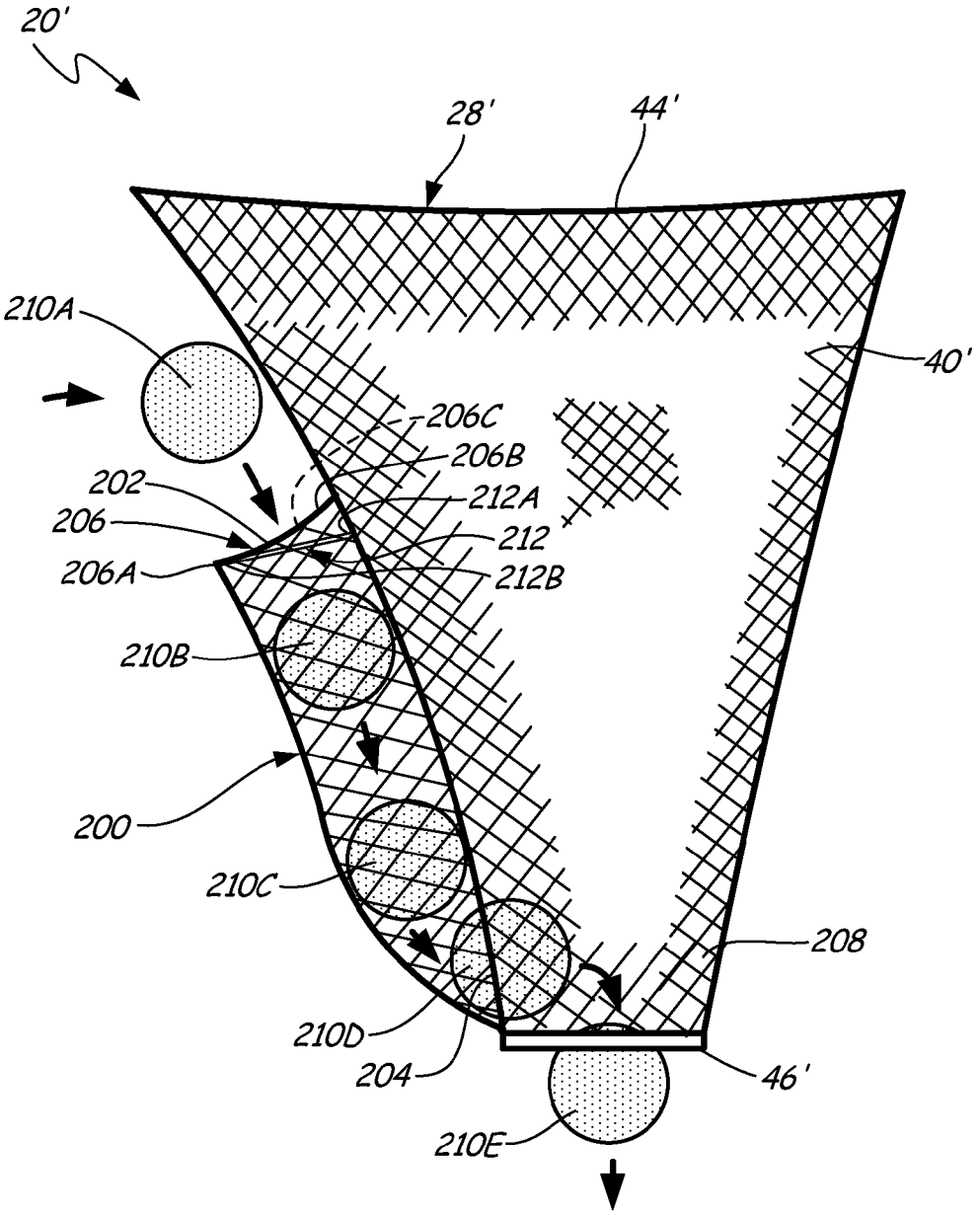
FIG. 12 is a side view of an alternative embodiment of a ball collector for use with a basketball return apparatus.
Figure 13:
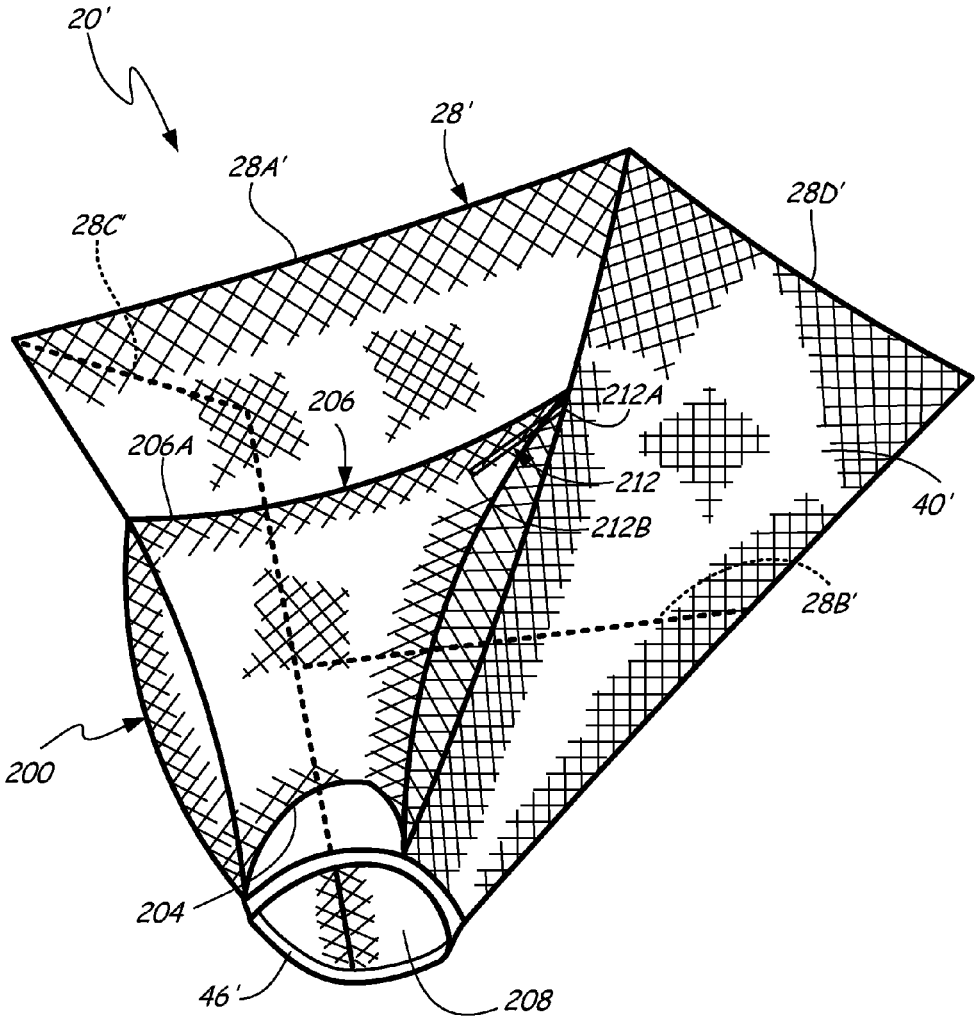
FIG. 13 is a perspective view of the ball collector of FIG. 12, having its second passage in a closed position.

FIGS. 12 and 13 illustrate ball collector 20', which is an alternative embodiment ball collector 20 (shown in FIGS. 1-4, 11). Ball collector 20' can be used with basketball return apparatus 12 (shown in FIGS. 1-11) in place of ball collector 20, or with virtually any suitable basketball return apparatus. FIG. 12 is a side view of ball collector 20'. Ball collector 20' includes net 40' having top opening 44' (defined by rim 28') and bottom opening 46'. Ball collector 20' is similar to ball collector 20 in that ball collector 20' can collect basketballs shot at hoop 18 (shown in FIG. 1) by funneling basketballs that pass through top opening 44' to and through bottom opening 46' and eventually to ball returner 22 (shown in FIGS. 1-4, 7-11).

Ball collector 20' differs from ball collector 20 in that ball collector 20' includes second passage 200. Second passage 200 is defined by net 40' between second passage top opening 202 and second passage bottom opening 204. Second passage top opening 202 is defined by second passage rim 206 (which includes front portion 206A and side portions 206B and 206C). Second passage 200 functions so that basketballs passed or thrown through second passage top opening 202 are funneled through second passage bottom opening 204 into main chamber 208 of ball collector 20'. Main chamber 208 is defined by net 40' between top opening 44' and bottom opening 46'. Basketballs are then discharged through bottom opening 46' and are eventually returned to ball returner 22. The path of a basketball through second passage 200 are illustrated by ball positions 210A-210E. Second passage 200 is sized to allow basketballs to be passed into second passage top opening 202 and to pass through to main chamber 208.

One or more rigid supports 212 can be used to hold second passage rim 206 in an open position. In the illustrated embodiment, rigid support 212 is a pole with first end 212A hingedly connected to net 40' at an intersection between second passage 200 and main chamber 208. Rigid support 212 has second end 212B detachably connected to second passage rim 206 at an intersection between front portion 206A and side portion 206B. In an alternative embodiment, rigid support 212 can have virtually any structure and configuration suitable for holding second passage rim 206 in an open position.

Thus, ball collector 20' has two independent inlets: top opening 44' being the first inlet and second passage top opening 202 being the second inlet. Ball collector 20' also has one outlet: bottom opening 46'. Top opening 44' is at a height suitable for collecting basketballs shot at basketball goal 14 (shown in FIGS. 1 and 2). Second passage top opening 202 is at a height suitable for a user to pass basketballs into ball collector 20'. Second passage top opening 202 is sized, shaped, and angled for receiving balls passed by a user. This allows users to pass basketballs into ball collector 20' through second passage top opening 202, instead of requiring users to pass basketballs up and over top opening 44'. Because second passage top opening 202 is positioned vertically lower than at least a portion of top opening 44' and at a more convenient angle, a user can more easily pass basketballs into ball collector 20' when basketball return apparatus 12 is being operated away from basketball goal 14 (as shown in FIG. 2). Therefore, second passage 200 allows basketball return apparatus 12 to be operated away from basketball goal 14 in a relatively convenient manner, without requiring ball collector 20' to be rotated. Ball collector 20' need not be rotatable with respect to ball returner 22 whatsoever. Thus, ball collector 20' can be operated without turntable 26 (shown in FIGS. 1-4, 7-11) and without extendable ramp section 50B (shown in FIGS. 3-6).

FIG. 13 is perspective view of ball collector 20' with second passage 200 in a closed position. In the closed position, second end 212B of rigid support 212 is detached from second passage rim 206. Front portion 206A of second passage rim 206 is adjacent a surface of net 40' at main chamber 208. Thus, second passage 200 is effectively closed. Ball collector 20' can be operated with second passage 200 in the closed position when being used near basketball goal 14 (as shown in FIG. 1) or any time when second passage 200 is not needed. Second passage 200 is thus openable and closable by a user.

Like rim 28 (shown in FIGS. 1-4), rim 28' has front portion 28A', back portion 28B', and side portions 28C' and 28D'. Front and side portions 28A', 28C', and 28D' of rim 28' are vertically higher than hoop 18 (shown in FIGS. 1 and 2) to improve the ability of ball collector 20' to collect basketballs that bounce off of hoop 18. Back portion 28B' of rim 28' is lower than hoop 18 to allow ball collector 20' to be positioned under hoop 18 without interfering with hoop 18. Thus, front and side portions 28A', 28C', and 28D' combine to form a high portion of rim 28', and back portion 28B' acts as a low portion of rim 28'. Second passage rim 206 and front portion 28A' of rim 28' are both on a front side of ball collector 20', substantially opposite back portion 28B' of rim 28'.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims. For example, the shape, size, and positioning of various supports, hinges, nets, and other components need not be precisely as illustrated. Rather, shape, size, and positioning of each component can be varied so as to be suitable for a particular application. Additionally, a basketball return apparatus can have additional sensors, motors, electronics, or other features not specifically described herein without departing from the essential scope of the invention.

The invention claimed is:

1. A basketball return apparatus for collecting and returning basketballs, the apparatus comprising:

a floor supported base;

a ball collector having a top opening and a bottom opening, wherein the top opening is sized larger than a basketball goal so as to collect basketballs that miss the basketball goal;

a ball returner connected to the floor supported base for receiving balls from the bottom opening of the ball collector and returning the balls to a user; and a rotatable support mechanism connecting the ball collector to the floor supported base so that the ball collector is supported by the floor supported base and is rotatable with respect to the floor supported base and the ball returner wherein said ball returner is positioned to receive balls from the bottom opening of the ball collector along a first ball pathway between the ball collector and the ball returner when the rotatable support mechanism is rotated in a first rotational position and along a second ball pathway between the ball collector and the ball returner that is different than the first ball pathway when the rotatable support mechanism is rotated in a second rotational position.

2. The apparatus of claim 1, wherein the support mechanism comprises:

a frame connected to and supporting the ball collector; and a turntable including:

a bottom platform fixedly connected to the floor supported base; and a top platform rotatably connected to the bottom platform and fixedly connected to the frame.

3. The apparatus of claim 2, and further comprising:

a low friction gasket positioned between the top platform and the bottom platform to facilitation rotational movement between the top platform and the bottom platform.

4. The apparatus of claim 1, wherein the support mechanism is actuable from a first support position where the ball collector is substantially extended and open to a second support position where the ball collector is substantially collapsed.

5. The apparatus of claim 4, and further comprising:

a motor for actuating the support mechanism between the first support position and the second support position.

6. The apparatus of claim 1, wherein the top opening is defined by a collector rim having a high portion and a low portion.

7. The apparatus of claim 6, wherein the high portion is higher than about 10 feet from ground level and the low portion is lower than about 10 feet from ground level.

8. A basketball return apparatus of claim 1, and further comprising:

an extendable ramp connected to the base, wherein a first ball pathway is created between the ball collector and the ball returner when the ball collector is in a first rotational position and the extendable ramp is in a first ramp position, and wherein a second ball pathway is created between the ball collector and the ball returner when the ball collector is in a second rotation position and the extendable ramp is in a second ramp position, wherein the extendable ramp is connected to the base via the rotatable support mechanism.

9. The apparatus of claim 1, wherein the support mechanism comprises:

a vertical support pole; and a lever bar hingedly attached to the vertical support pole, and having:

a connection plate hingedly connecting the lever bar to frame poles of the ball collector; and a handle for rotating the lever bar to lift the frame poles into an elevated position.

10. The apparatus of claim 1, wherein the ball returner includes:

a first motor for driving the ball returner to throw basketballs to the user; and a second motor for pivoting the ball returner with respect to the floor supported base.

11. The apparatus of claim 1, wherein the support mechanism comprises:

a turntable positioned between a lower end of the ball collector and the floor supported base for allowing the ball collector to rotate with respect to the floor supported base.

12. The apparatus of claim 1, wherein the rotatable support mechanism rotates about 180 degrees from the first rotational position to the second rotational position.

13. The apparatus of claim 1, wherein the ball collector comprises:

a frame connected to the support mechanism; and a net connected to the frame so as to funnel basketballs that enter the top opening to and through the bottom opening.

14. A basketball return apparatus for collecting and returning basketballs, the apparatus comprising:

a base;

a ball collector having a top opening and a bottom opening;

a ball returner connected to the base for receiving balls from the bottom opening of the ball collector and returning the balls to a user;

a rotatable support mechanism connecting the ball collector to the base so that the ball collector is rotatable with respect to the base and the ball returner;

an extendable ramp connected to the base, wherein a first ball pathway is created between the ball collector and the ball returner when the ball collector is in a first rotational position and the extendable ramp is in a first ramp position, and wherein a second ball pathway is created between the ball collector and the ball returner when the ball collector is in a second rotation position and the extendable ramp is in a second ramp position; and wherein the extendable ramp is part of the second pathway when the extendable ramp is in the second ramp position and the rotatable support mechanism is in the second rotational position and wherein the extendable ramp diverts balls from the first ball pathway to the second ball pathway when the extendable ramp is in the second ramp position.

15. The apparatus of claim 14, wherein the extendable ramp is hingedly connected to the rotatable support mechanism.

16. The apparatus of claim 14, wherein the extendable ramp includes a main ramp section hingedly connected to an extendable ramp section.

17. The apparatus of claim 14, wherein the extendable ramp section is substantially vertical in the first ramp position, and wherein the extendable ramp section is inclined in the second ramp position.

18. The apparatus of claim 14, wherein the extendable ramp comprises a plurality of rails for guiding a ball from the bottom opening of the ball collector to the ball returner when in the second ramp position.

19. A method for operating the basketball return apparatus of claim 1, the method comprising:

positioning the basketball return apparatus on a basketball court near a basketball goal such that a low portion of a collector rim of the ball collector is proximate the basketball goal and the ball returner is aimed toward a playing area of the basketball court;

operating the basketball return apparatus to collect basketballs shot at the basketball goal and return those basketballs to a user when the basketball return apparatus is near the basketball goal;

positioning the basketball return apparatus on the basketball court away from the basketball goal such that the ball returner is aimed in a direction toward a playing area of the basketball court;

rotating the ball collector with respect to the basketball return apparatus such that the low portion of the collector rim is facing substantially the same direction as the ball returner is aimed when the basketball return apparatus is positioned away from the basketball goal; and operating the basketball return apparatus to collect basketballs passed into the ball collector and return those basketballs to the user when the basketball return apparatus is positioned away from the basketball goal.

20. The method of claim 19, wherein the ball collector is rotated about 180 degrees with respect to the ball returner.

21. The method of claim 19, and further comprising:

extending a ramp to create a ball path between the ball collector and the ball returner.

* * * * *